US006443874B1

(12) United States Patent
Bennett

(10) Patent No.: US 6,443,874 B1
(45) Date of Patent: Sep. 3, 2002

(54) OCCUPATIONAL - THERAPY APPARATUS FOR STRENGTHENING FINGERS, HAND, WRIST, FOREARM AND FOOT

(76) Inventor: Mark Bennett, 6404 N. Richmond, #205, Chicago, IL (US) 60645

( * ) Notice: Subject to any disclaimer, the term of this patent is extended or adjusted under 35 U.S.C. 154(b) by 0 days.

(21) Appl. No.: 09/657,787

(22) Filed: Sep. 8, 2000

Related U.S. Application Data

(60) Provisional application No. 60/153,141, filed on Sep. 9, 1999.

(51) Int. Cl.[7] ..... A63B 21/06; A63B 23/16

(52) U.S. Cl. ..... 482/44; 482/47; 482/100; 482/139; 482/908; 601/40; 128/845

(58) Field of Search ..... 482/10, 44–50, 482/80, 92–94, 97–100, 133–139, 905, 907, 908; 601/40, 23, 24; 128/845, 878

(56) References Cited

U.S. PATENT DOCUMENTS

| | | | | |
|---|---|---|---|---|
| 1,204,437 A | * | 11/1916 | Heinze | 482/48 |
| 3,374,675 A | * | 3/1968 | Keropian | 601/24 |
| 3,495,824 A | * | 2/1970 | Cuinier | 482/44 |
| 4,679,548 A | * | 7/1987 | Pecheux | 601/40 |
| 4,730,829 A | * | 3/1988 | Carlson | 482/5 |
| 4,802,462 A | * | 2/1989 | Reiss et al. | 601/35 |
| 4,817,943 A | * | 4/1989 | Pipasik | 482/97 |
| 4,822,027 A | | 4/1989 | Kascak | |
| 5,170,777 A | | 12/1992 | Reddy et al. | |
| 5,184,991 A | * | 2/1993 | Brangi | 482/97 |
| 5,209,223 A | * | 5/1993 | McGorry et al. | 601/34 |
| 5,380,259 A | | 1/1995 | Robertson et al. | |
| 5,454,773 A | * | 10/1995 | Blanchard et al. | 482/133 |
| 5,466,204 A | * | 11/1995 | Nearing | 482/102 |
| 5,569,124 A | | 10/1996 | Raynie et al. | |
| 5,713,370 A | | 2/1998 | Cook | |
| 5,722,937 A | * | 3/1998 | Smith | 601/23 |
| 5,738,613 A | | 4/1998 | Clayton | |
| 6,036,621 A | | 3/2000 | Hancock | |

OTHER PUBLICATIONS

Electromyographic Study of the Wrist Flexor and Extensor Muscles . . . ,Masters Thesis by Mark Bennett, 1990.

Hand–Therapy Catalog::, North Coast Medical; pp. 60,61, 65,77,84, and 85;1995.

* cited by examiner

*Primary Examiner*—Jerome W. Donnelly
*Assistant Examiner*—Victor Hwang
(74) *Attorney, Agent, or Firm*—Hamman & Benn

(57) ABSTRACT

An occupational-therapy/physical-therapy apparatus is disclosed and includes at least one pivotal or rotatable resistance against which the body part being exercised is located. A resistance bar is biased to act against the body part, which bias is adjustable. Operatively associated with the resistance bar is at least one stabilization bar that is used to support a part of the body in close proximity to the body part engaged against the resistance bar, in order to provide the most optimal support to the body part being exercised. Each of the resistance bar and the stabilization bar has a multitude of degrees of freedom of motion, which in the preferred embodiment total six degrees of freedom, so that numerous types of exercises may be performed on numerous different body parts, and so that the most optimal orientation of the body part may be achieved, where both horizontal, vertical and angular orientations of the body parts may be accomplished while the body part is being exercised. The pivotal movement of the resistance bar or lever is infinitely adjustable by an adjustable, angular control mechanism, in order that the apparatus of the invention is most optimally suited and safe for all types of patients, body parts, and exercises. The angular starting point, and therefore the end point, of movement of the pivotal resistance bar is also adjustable.

31 Claims, 7 Drawing Sheets

OCCUPATIONAL - THERAPY APPARATUS FOR STRENGTHENING FINGERS, HAND, WRIST, FOREARM AND FOOT

This application claims benefit of Provisional Application Ser. No. 60/153,141 filed Sep. 9, 1999.

BACKGROUND OF THE INVENTION

The apparatus of the invention is a device made to strengthen fingers, hand, wrist, forearm or foot and ankle using resistance therapy for strengthening individual muscles and muscle groups.

Present therapy apparatuses for strengthening individual muscles and muscle groups and for testing finger and wrist muscles are with pinch meters or dynamometers, which test only isometric or static pinch and grip strength. Individual movements of the digits of the hand cannot be tested. Manual muscle testing can be done with this device, which is the fundamental strength screening tool used by doctors and therapists. It can test the strength, and, also, may be used for strength training of individual or groups of muscles.

The occupational-therapy of the present invention, on the other hand, will isolate muscles better and more safely than any other means of hand strengthening, because the amount of weight for a specific injury can be prescribed, where now, inaccuracy of products used for resistance activity will allow greater chance of injury. An additional reason why the apparatus of the invention is safer and isolates muscles better, is that it provides much greater stability, decreasing the chance for muscle substitution, (muscles other than the one's desired, compensating for the weaker muscles).

The above are referred to as blocking exercises. A therapist must stabilize the metacarpophalangeal (MP) joint and intercarpophalangcal (IP) joints to exercise the distal-intercarpophalangeal joint (DIP). For example, with the apparatus of the present invention, the MP would rest on an adjustable arm rest and the IP joint is stabilized by a multi-positional, multi-adjustable stabilizer bar. The DIP would move the resistance bar, for DIP flexion exercises, with the hand pronated (palm down), the distal DIP would hang over the edge of the armrest, and the stabilizer bar would go just proximal (closer to the hand) to the IP joint. The DIP would then push the resistance bar downward. This is the gravity-assisted position, which is another feature of this present invention. It allows the use of gravity for very weak muscles. Muscles that cannot move against gravity, are assisted by gravity, and, thus, can begin resistance activity earlier.

Resistance activity has been shown to be the most effective means of strengthening muscles. By starting it earlier, a shorter recovery period should be seen and perhaps even a better, more complete recovery. This same exercise can be done in the supinated position as well (palm facing upward). The DIP rests over the end of the armrest with the stabilizer bar just proximal to and on top of the DIP joint. The joint fingertip is move upwardly, pushing the resistance bar that is placed at the center of the digit.

The apparatus of the present invention provides an occupational-therapy/physical-therapy device that is more effective, safer, and allows a multitude of different strengthening exercises on a number of different parts of the body not hitherto possible on just one machine.

SUMMARY OF THE INVENTION

It is, therefore, the primary objective of the present invention to provide occupational-therapy/physical-therapy device that is more effective, safer, and allows a multitude of different strengthening exercises on a number of different parts of the body not hitherto possible on just one machine.

It is another objective of the present invention to provide an occupational-therapy/physical-therapy device that is more effective, safer, and allows a multitude of different strengthening exercises on a number of different parts of the body not hitherto possible on just one machine, in which there are provides at least one multi-adjustable and multi-positional stabilization bar or element that is operatively associated with a resistance bar, which allows the most optimal positional of the joint, or other body part, being exercised relative to the resistance bar.

It is yet another objective of the present invention to provide an occupational-therapy/physical-therapy device that is more effective, safer, and allows a multitude of different strengthening exercises on a number of different parts of the body not hitherto possible on just one machine, and which allows a plurality of degrees of freedom of movement to both the stabilization bar and resistance bar, whereby the multitude of different strengthening exercises for a multitude of different body part may be achieved.

It is an objective of the present invention to provide an occupational-therapy/physical-therapy device that is more effective, safer, and allows a multitude of different strengthening exercises on a number of different parts of the body not hitherto possible on just one machine, wherein the arcuate degree to which the resistance bar or lever may be rotated is infinitely adjustable, in order to suit each patient and each body part being exercised.

Toward these and other ends, the occupational-therapy/physical-therapy apparatus of the present invention includes at least one pivotal or rotatable resistance against which the body part being exercised is located. The resistance-element means is biased to act against the body part, which bias is adjustable. Operatively associated with the resistance-element means is at least one stabilization-element means that is used to support a part of the body in close proximity to the body part engaged against the resistance-element means, in order to provide the most optimal support to the body part being exercised. Each of the resistance-element means and the stabilization-element means has a multitude of degrees of freedom of motion, which in the preferred embodiment total six degrees of freedom, so that numerous types of exercises may be performed on numerous different body parts, and so that the most optimal orientation of the body part may be achieved, where both horizontal, vertical and angular orientations of the body parts may be accomplished while the body part is being exercised. The pivotal movement of the resistance-element means or lever is infinitely adjustable by means of an adjustable, angular control mechanism, in order that the apparatus of the invention is most optimally suited and safe for all types of patients, body parts, and exercises. The angular starting point, and therefore the end point, of movement of the pivotal resistance-element means is also adjustable. In another embodiment of the invention, a device is provided for use with the resistance-element means that, when using the apparatus for digit-strengthening exercises, the fingers are positioned along their convergence lines toward their convergence point, to ensure optimal positioning of the fingers and to prevent damage to them.

BRIEF DESCRIPTION OF THE DRAWINGS

Reference is had to the accompanying drawings, wherein.

DETAILED DESCRIPTION OF THE INVENTION

Figure 1:
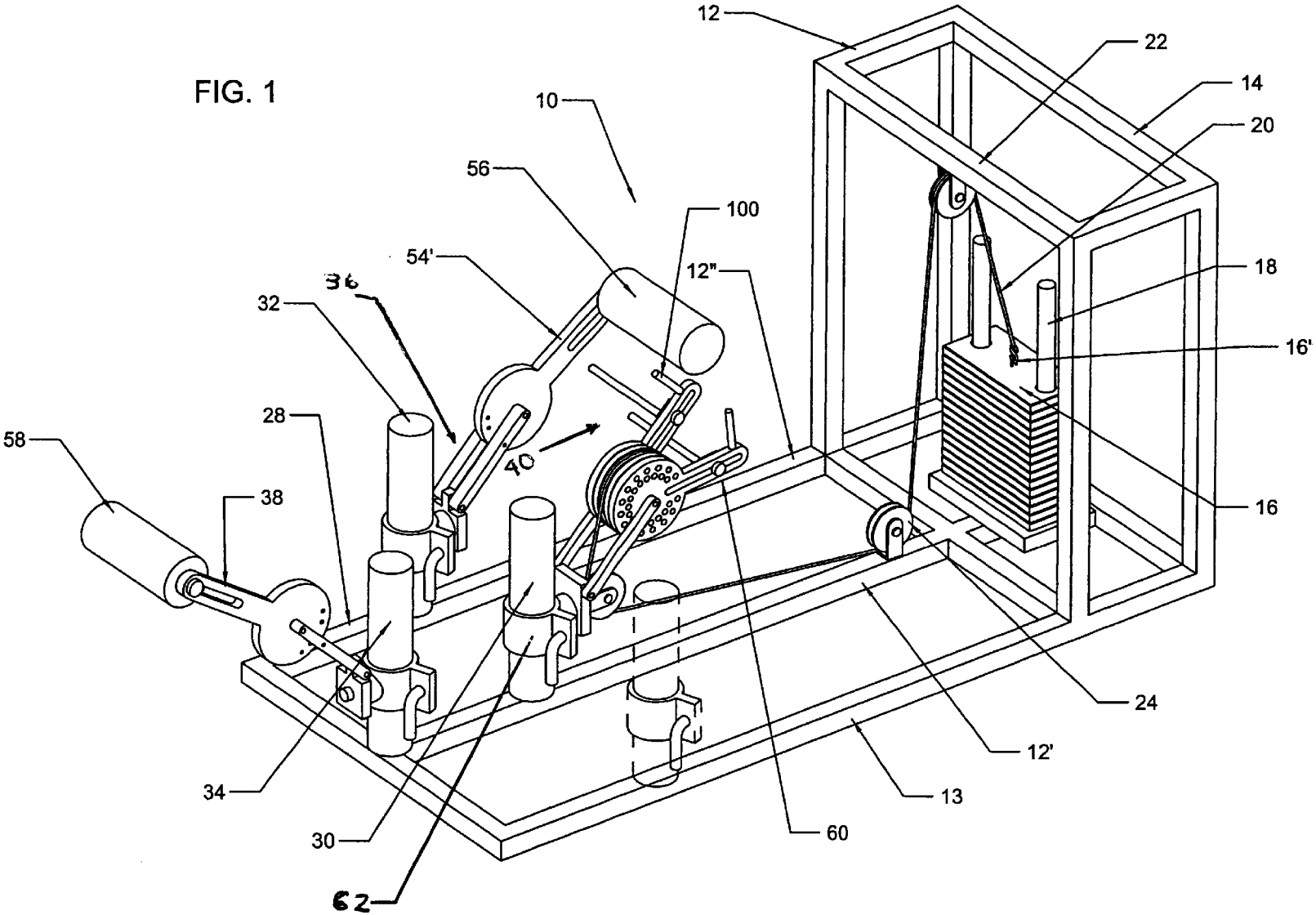
FIG. 1 is an isometric view of the occupational-therapy apparatus for strengthening Fingers, hands, wrists, forearms, feet and ankles according to the invention.

Referring now to the drawings in greater detail, the occupational-therapy apparatus of the present invention is indicated generally by reference numeral 10. This apparatus will allow a plethora of different resistance exercises to the fingers, wrist, hand, forearm, foot and ankle not hitherto possible to be performed on any prior-art apparatus, and in a manner surpassing the results of the prior-art apparatuses, as described hereinbelow in greater detail.

The apparatus 10 consists of a tubular main frame 12 to which are mounted the operating parts of the apparatus of the invention. The main frame has a bottom section consisting of preferably three bottom, or lower, tubular elements 12', 12", and 13. The main frame also has a rear section 14 in which is mounted a series of flat weight-elements 16, each weight-element having a pair of spaced-apart holes for receiving therethrough a pair of upstanding guide-posts 18 by which the flat weight-elements are slid in an up and down motion along the guide-posts. Each weight-element 16 also has a centrally-located, smaller-diameter hole 16' for receiving a hook 16", which hook is used for attaching an end of a tie-wire 20 to the topmost weight-element 16. The tie-wire is looped over first pulley 22, and then under second pulley 24. The first pulley is secured to an upper portion of the rear-section 14 of the main frame, while the second pulley 24 is secured to the central portion of the bottom, central tubular element 12' of the main frame. The other end of the tie-wire 20 is fastened in any conventional manner to the resistance and brake assembly, as described in detail hereinbelow, whereby different biasing forces may be applied against a resistance bar used for executing various and multiple strengthening exercises. By changing the number of flat weight-elements 16 being used, the weight to be lifted by the tie-wire may be changed, and, therefore, the biasing or resistance force provided by the resistance and break assembly on the resistance bar may be chanced, as needed, according to the type of exercise being performed, the body part being exercised, and in order to suit the needs of any specific patient being treated.

The main frame 12 has a forward section 28 to which are mounted the remainder of the operating parts of the apparatus 10 of the invention. Each of the bottom tubular elements 12' and 12" mount an upstanding mounting column 30, 32, respectively, with the middle column also mounting an additional column 34. Each of the columns 32 and 34 mounts a multi-positionable, adjustable stabilization-element assembly 36, 38, respectively. The column 30 mounts a resistance-bar assembly 40. The two stabilization-element assemblies 36, 38 are used in conjunction with the resistance-bar assembly 40, in order to firmly and safely support a portion of the body, such as a forearm, in order that the joint or body part to be operatively associated with, and in contact against, the resistance-bar assembly is most optimally located with reference to the resistance-bar assembly, as detailed hereinbelow.

Figure 3:
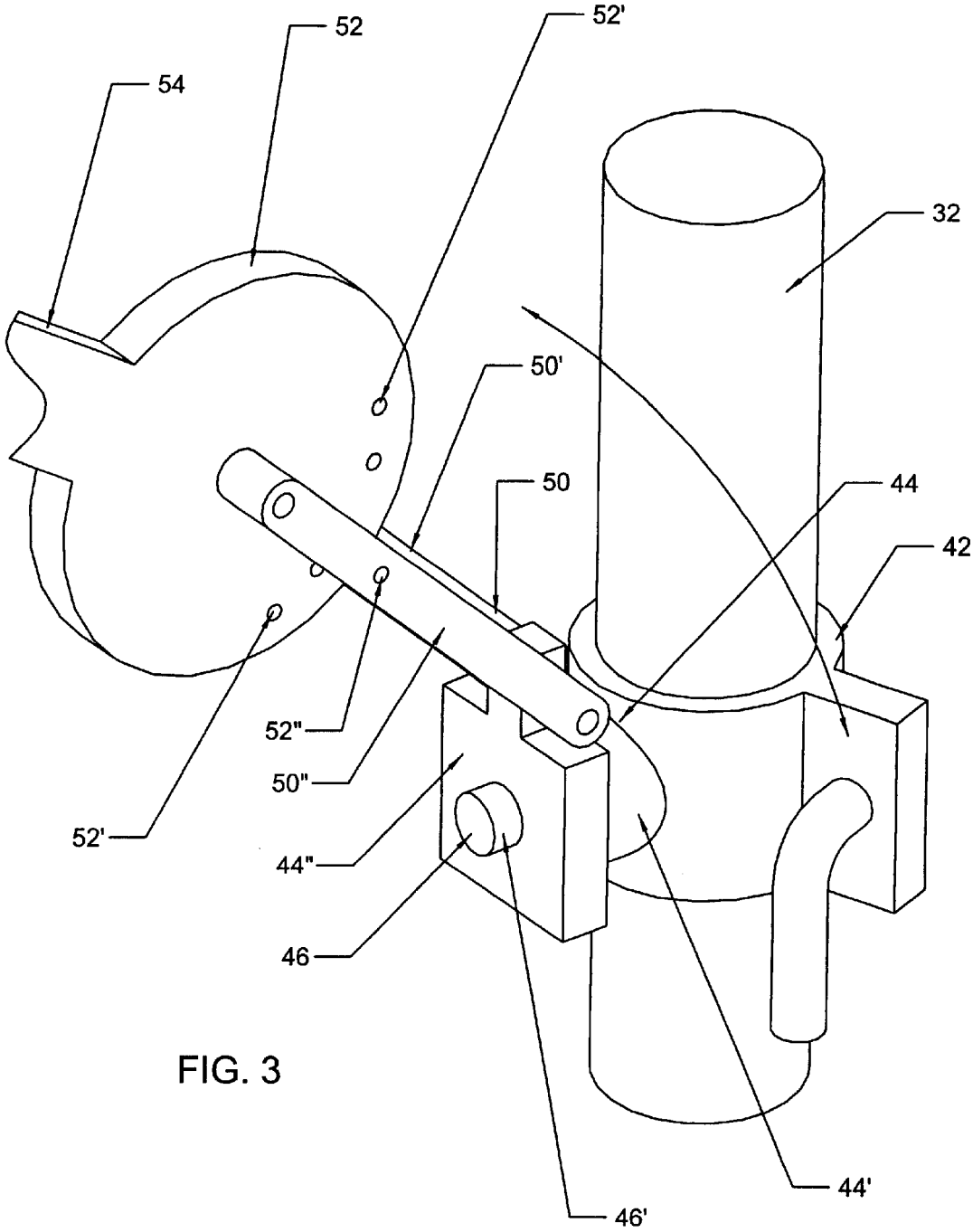
FIG. 3 is a detailed isometric view of the mounting of each of the adjustably positional stabilization bars of the apparatus of FIG. 1, which mounting allows several degrees of freedom of motion, in order that the multitude of exercises on a number of different body parts may be performed on the apparatus of the present invention.

Turning now to FIGS. 1 and 3, each stabilization-element assembly 36, 38 consists of a U-shaped mounting clamp 42 entrained about upstanding column 32 or 34. The clamp 42 is clamped in place by a locking lever, in conventional manner, whereby the vertical height of the stabilization-element assembly bay be adjusted along a respective column, and whereby the entire assembly may be rotated in a horizontal plane. Connected to the U-shaped clamp is a mounting bracket 44 consisting of a first cylindrical portion 44', and a second rectilinear-shaped plate-portion 44" connected to the first portion 44' via a pivot shaft unit 46. Thus, a portion of the stabilization assembly is rotatable about pivot shaft unit 46 for a full 360-degrees in the vertical plane, such that the entire stabilization assembly may be oriented in a fully horizontal plane, as opposed to a vertical plane as shown in the drawings. A horizontal orientation would have especial relevance when the apparatus 10 is used for performing strengthening exercises on feet. The rectilinear plate-portion 44" is locked in place via a female-threaded end-cap or nut 46', or by any other conventional means. Pivotally secured to the top surface of the second rectilinear-shaped portion 44" is a bifurcated arm-assembly 50 having a pair of arms 50', 50" at the ends of which is mounted a rotatable mounting disc 52, wherein a portion of the disc 52 is nestled in between the ends of the arms 50', 50". The disc 52 is rotatably mounted between the ends of the arms 50', 50" by means of a pivot pin extending between the ends of the arms 50', 50". The disc 52 also has a series of arcuately-spaced holes 52' which cooperate with holes 52" formed near the ends of the leg-extensions 50', 50" of the bifurcated arm 50, by which a locking pin passing through both the holes 52" and one of the holes 52', by which the disc 52 may be rotatably oriented in a desired position for positioning a stabilization-element means, at a desired separation from the resistance-element means, as described below. Extending from the disc 52, and integral therewith, is an elongated leg-section 54, which leg-section is provided with a central, elongated groove 54' (see FIG. 1), in which groove is slidably mounted an end of a shaft associated with stabilization bar or element 56 or 58, whereby the stabilization-element means 56, 58 may be translationally adjusted therealong, in order to locate it in the most desired juxtaposition relative to the resistance bar. Therefore, it may be seen that each stabilization-element means 56, 58 has the additional freedom of movement of rotation in a vertical plane perpendicular to the vertical plane provided by the second rectilinear-shaped portion 44", as well as the additional freedom of translational movement via the groove or channel 54'. Thus, six degrees of movement are provided to each stabilization-element means 56, 58, in order to perform all of the exercises allowed by the apparatus 10, and in order to accommodate different joints and body parts, as well patients of different strength, size, health, etc.

Referring now to FIGS. 1, 2, 4 and 5, the resistance-bar and breaking assembly 60 is shown. The assembly 60 is mounted to its upstanding column 30 via a similar mount as each of the stabilization-element assemblies 36, 38. A U-shaped mounting clamp 62 is entrained about upstanding column 30. The clamp 62 is clamped in place by a locking lever, in conventional manner, whereby the vertical height of the assembly 60 may be adjusted along a respective column, and whereby the entire assembly may be rotated in a horizontal plane. Connected to the U-shaped clamp is a mounting bracket 64 consisting of a first cylindrical portion 64', and a second rectilinear-shaped plate-portion 64" connected to the first portion 64' via a pivot shaft unit. Thus, a portion of the resistance/brake assembly 60 is rotatable about a pivot shaft unit for a full 360-degrees in the vertical plane, such that the assembly 60 may be oriented in a fully horizontal plane, as opposed to a vertical plane as shown in the drawings, and as described with regard to the stabilization assemblies 36, 38. A horizontal orientation would have especial relevance when the apparatus 10 is used for performing strengthening exercises on feet. The rectilinear plate-portion 64" is locked in place via a female-threaded end-cap or nut, or by any other conventional means. Pivotally secured to the second rectilinear-shaped portion 64" is a bifurcated arm-assembly 70 having a pair of arms 70', 70" at the distal ends of which is rotatably mounted a resistance/brake unit 72, as clearly seen in FIG. 2. The resistance/brake unit 72 is rotatably mounted between the ends of the arms 70', 70" by means of a pivot pin 71 extending between the ends of the arms 70', 70". Attached to the resistance/brake unit 72 is a pair of resistance bar or element units 74, 76, one bar unit at each end of the unit 72. The resistance/brake unit 72 is that which is usually associated and used with the pair of stabilization-bar assemblies 36, 38, although, owing to the many degrees of freedom allotted each of the stabilization-bar assemblies and resistane/brake unit, the unit 76 could also be oriented near the stabilization-bar assemblies 36, 38, or vice-versa. Each resistance bar unit 74, 76 consists of an outwardly-projecting, cantilevered ounting arm 80, 82, respectively, in which is formed an elongated groove or channel 80', 82'. Each channel receives therein for sliding movement a slide-mount 80", 82", each of which is connected to an end of a resistance bar or element proper 84, 86, respectively. The reistance bars or levers 84, 86 extend in the same direction, in the orientation shown in the drawings, which is in a direction toward the stailization bars or elenents 56, 58. Each slide-mount is comprised of a flat mounting plate or bracket 88, 90 affixed to an end of a respective resistance bar or lever 84, 86. Affixed to and projecting from the mounting plate and interiorly of the resistance bar, is a slide-rod which passes through a respective channel or slot 80,', 82', whereby eah resistance bar is allotted sliding translational movement along each cantilevered mounting arm 80, 82. Each resistance bar or lever 84, 86 is fixed in a desired location along a channel by means of a nut 92, 94, in the conventional manner. This sliding translational motion provides an additional degree of motion, as in the case of the stabilization bars or elements 56, 58. Each resistance bar unit 74, 76 also has, in the orientation as shown in the drawings, an upstanding bar 100, 102 extending perpendicularly to the resistance bar or lever 84, 86, respectively. Each upstanding bar 100, 102 is used for adding small, individual weight-elements 104, each having a weight preferably measured in grams or ounces. These weights are used when the resistance/brake assembly 72 is disconnected from the main biasing-force generator consisting of the weight-elements, 16, as described above. These small weight elements may preferably be used when finger exercises are being performed with the apparatus 10, for example. In addition, the resistance bar unit 76 is also used as a counterbalance to the resistance bar unit 74, as described hereinbelow. When the resistance bar unit 76 serves as a counterbalance, it is positioned diametrically opposite to the resistance bar unit 74.

Figure 2:
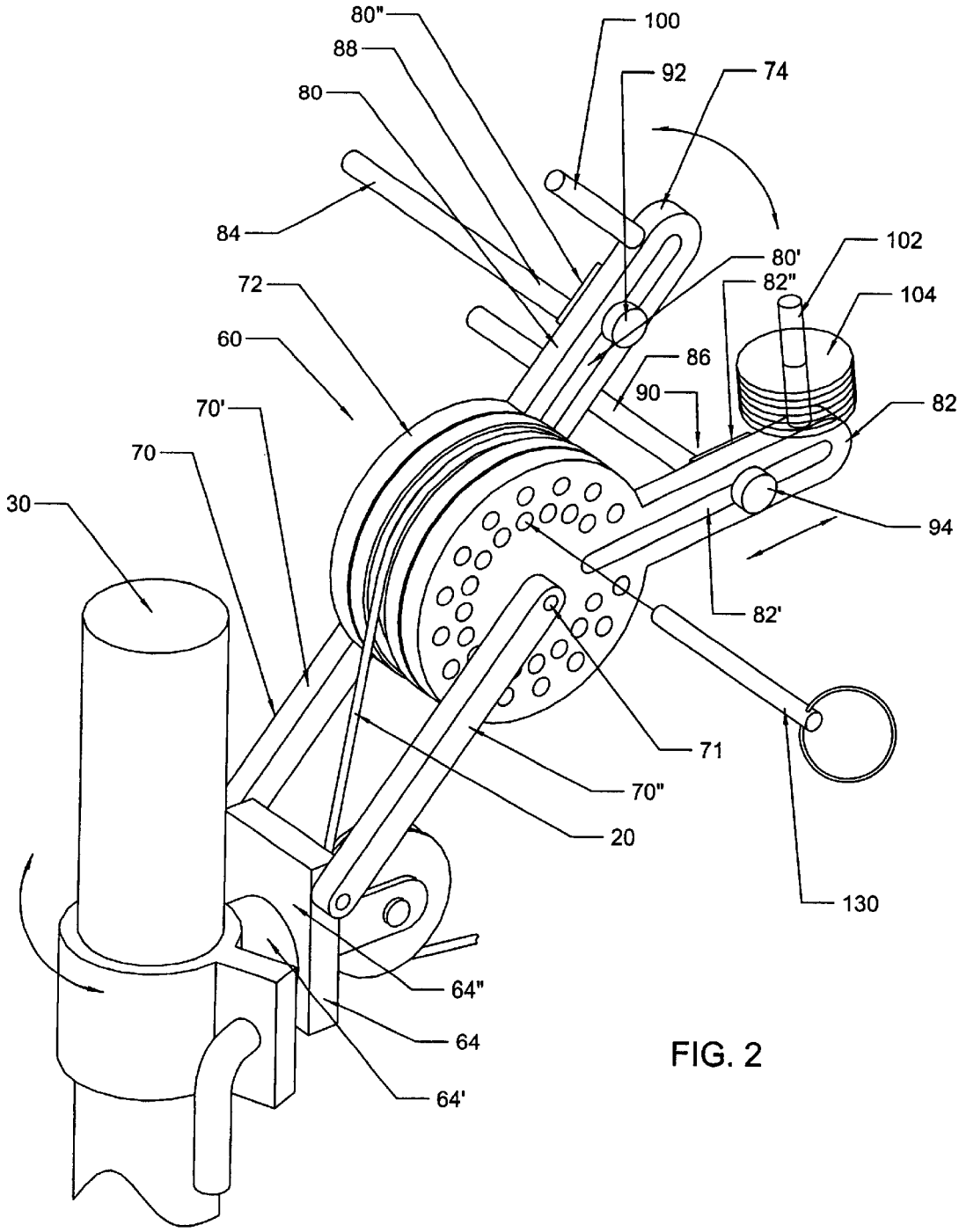
FIG. 2 is a detailed isometric view of the resistance assembly of the apparatus of FIG. 1 for providing the biasing forces allowing the performance of the multitude of exercises capable of being performed on the apparatus of the invention.
Figure 5:
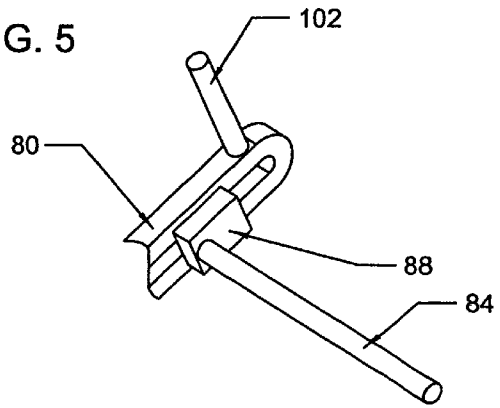
FIG. 5 is an detailed view, in perspective, of the resistance bar assembly which allows translational adjustment of the resistance bar, and which assembly offsets the translational mount from the axis of the resistance bar, in order that the axis of the resistance bar may be located as close as possible to the axis of the joint being moved.
Figure 4:
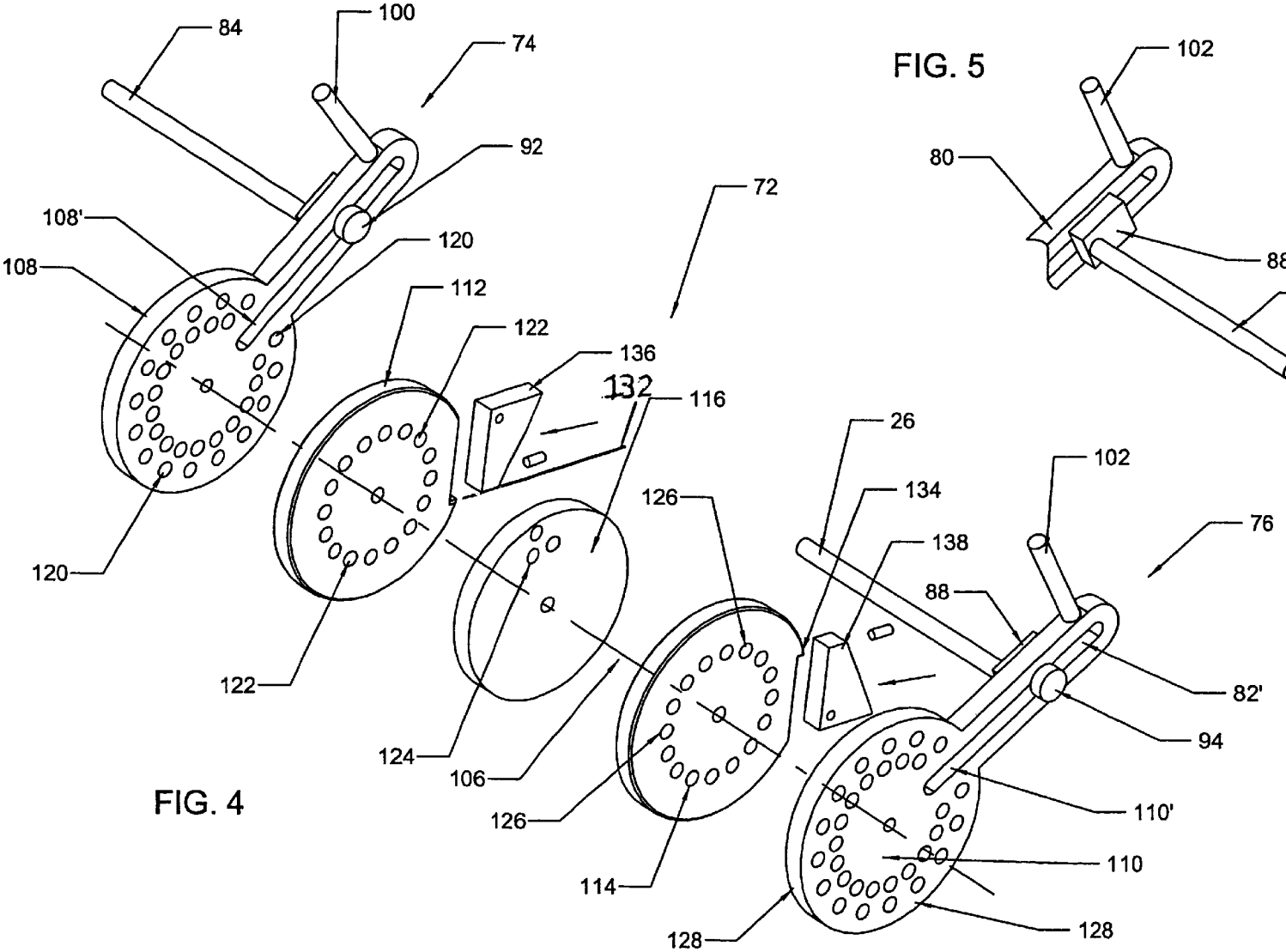
FIG. 4 is an assembly view, in perspective, showing the combination of the biasing-force assembly and breaking thereof for limiting rotation of the resistance bar, of the apparatus of FIG. 1 of the invention.

Turning now to FIGS. 2 and 4 specifically, the resistance/brake assembly 72 is shown in detail. The assembly 72 consists of a plurality of rotatably mounted discs, rotatable about a common, central longitudinal axis 106. In the preferred embodiment, the plurality of discs consist of a pair of outer rotatable discs 108, 110, to which are affixed the resistance-brake units 74, 76, respectively, whereby each unit 74, 76 may be rotated in order to provide the resistance bars 84, 86 with the necessary biasing force by which a strengthening exercise may be performed. Each of the outer discs 108, 100 has a channel-extension 108', 110', respectively, which is aligned with a respective channel. This channel extension receives therein a respective slide-rod of a respective resistance bar 84, 86, so that each resistance bar may be brought closer to the central axis for rotation 72. In addition, as seen in FIGS. 2 and 5, the fixed end of each resistance bar 84, 86 is affixed in a downwardly-offset fashion, when viewing FIG. 4, to the front surface face of a respective flat mounting plate or bracket 88, 90 affixed to an end of a respective resistance bar 84, 86, whereby when the respective slide-rod enters into a channel-extension 108', 110', the respective resistance bar 84, 86 is brought into close juxtaposition to the central rotational axis 106. This is very important for digit-strengthening exercises, since the axis 106 is aligned with the joint of the finger about which the joint is bent or flexed. It is this joint that rests on the stabilization bar 56, so that in order for the finger to contact against the resistance bar so that that particular joint, the resistance bar must be brought as close as possible to the stabilization bar as possible.

The other discs of the plurality of discs are a pair of interior-located brake discs 112, 114, which sandwich therebetween a centrally-located spacer-disc 116 to which is affixed the end of the tie-wire 20 (see FIG. 2), by which the tie-wire is wound thereabout as the resistance-bar element 84 is rotated downwardly, when viewing FIG. 2, in order to provide the biasing force necessary for performing the plethora of strengthening exercises using the apparatus 10. The centrally-located spacer-disc 116 also separates the two brake-discs 112, 114, in order to allow independent rotation to each, so that the degree of motion of the resistance-bar elements 84, 86 may be preset, as described below in detail.

Each of the rotatable discs is provided with a plurality of holes. The disc 108 has series of arcuate holes 120, the disc 112 has a series of arcuate holes 122, the disc 116 has series of arcuate holes 124, the disc 114 has series of arcuate holes 126, and the disc 110 has series of arcuate holes 128. Corresponding and aligned holes of the plurality of discs receive therethrough a locking pin 130 (FIG. 2), by which all of the discs are locked together in conjoint rotation about the pivot pin or shaft 71. Before the locking pin 130 is inserted, the two outer discs 108, 110 are independently rotated in order to orient the respective resistance-bar assembly 74, 76 at a desired position and location for performing the desired strengthening exercise. In conjunction therewith, the stabilization-element means 56, 58 are also oriented to locate them in the desired location in close juxtaposition to the respective resistance bar 84, 86.

Figure 6:
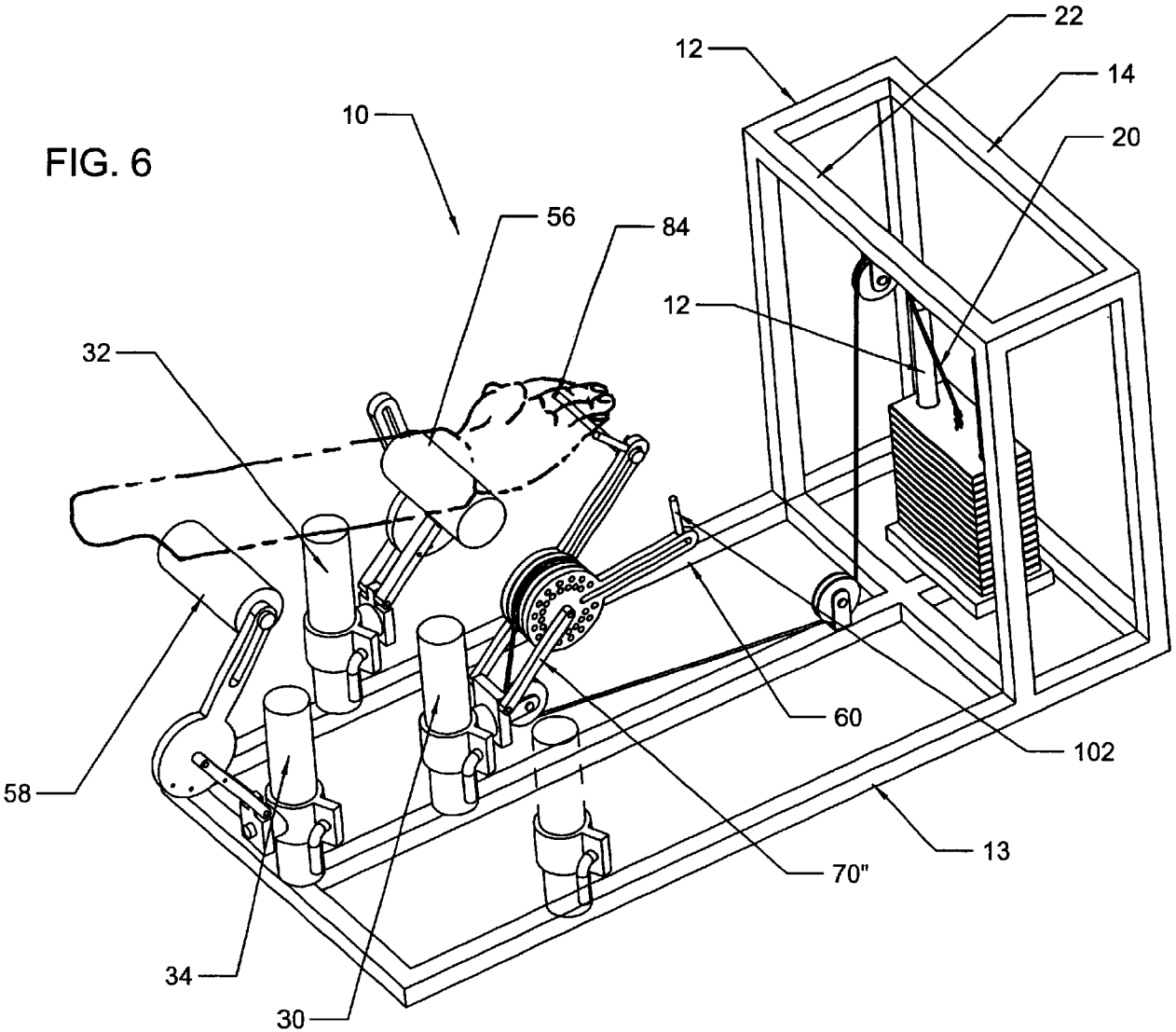
FIG. 6 is an isometric view similar to FIG. 1, but showing the apparatus in use for flexing the digits of a hand requiring therapy-strengthening, such exercise being MP flexure, by way of example, with the fingers in their downwardly-located position with the resistance bar rotated downwardly against the biasing force.
Figures 7, 8:
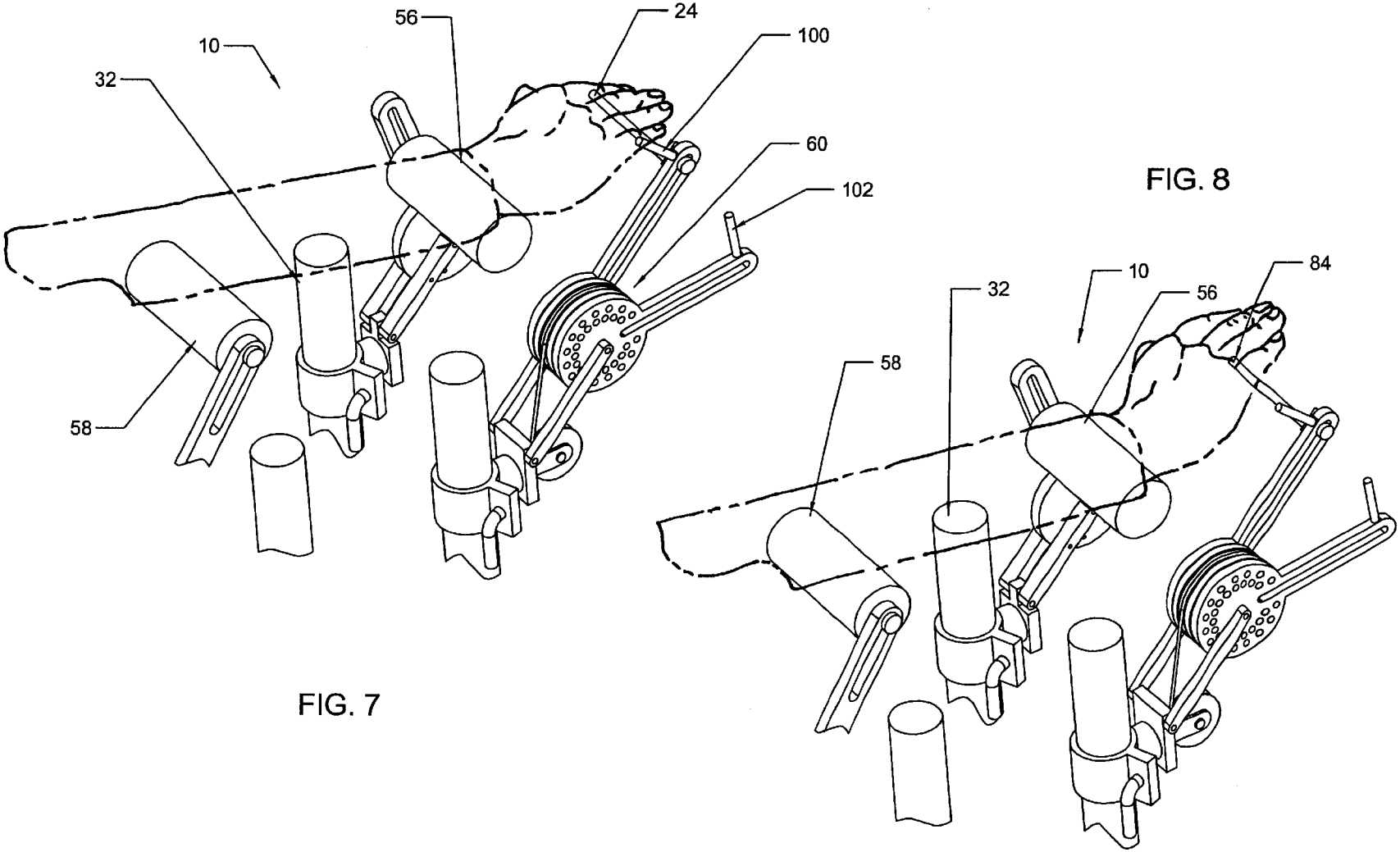
FIG. 7 is an isometric view similar to FIG. 6, but with the fingers brought partially back, whereby the resistance bar is rotated back upwardly toward its original position.
FIG. 8 is an isometric view similar to FIG. 7 but with the fingers brought all the way back, whereby the resistance bar is rotated back upwardly to its original position.
Figure 9:
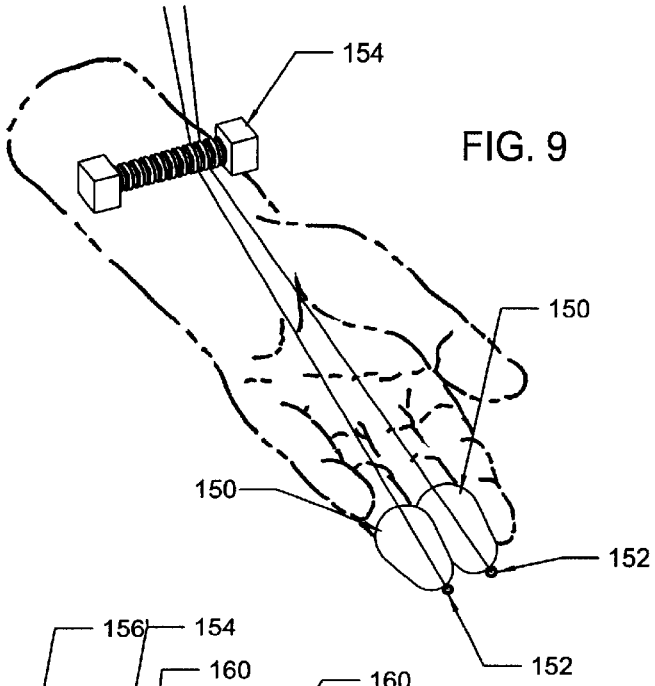
FIG. 9 is a perspective viewing a digit-strengthening exercise using the resistance-element means of the present invention by which the fingers being exercised are oriented such that their axes converge toward their convergence point.
Figure 10:
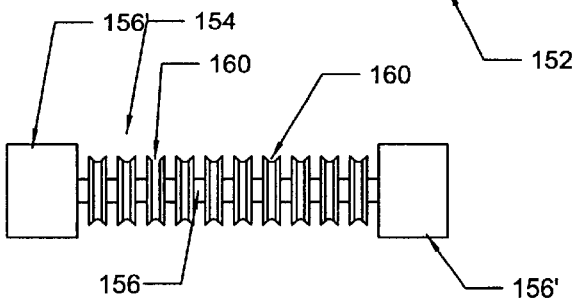
FIG. 10 is a plan view of the special element used in the exercise of FIG. 9 for orienting the fingers toward their convergence point.

Each of the brake-discs 112, 114 is provided with a circumferential notch or groove 132, 134 with cooperate a pair of conventional, spring-loaded pawls or latches 136, 138 mounted to a portion of the main frame. The latch 136 is inverted as compared to the latch 138, and the notch 132 faces downwardly, while the notch 134 faces upwardly, by which both counterclockwise and clockwise rotation of the brake-discs 112, 114 may be limited. By manually rotating the two brake-discs relative to each other, before the locking pin 130 has been inserted through the holes of the discs, the amount of angular rotation of each resistance bar or element 84, 86 may be preset to suit the type of strengthening exercise being performed and the patient being treated, with the limits to rotation being contact of the respective notches 132, 134 against the spring-biased pawls or locking levers 136, 138. Not only is the amount of angular movement of the resistance bars preset by this, but also the starting points thereof, as in the manner depicted in FIGS. 6 through 8.

Figure 11:
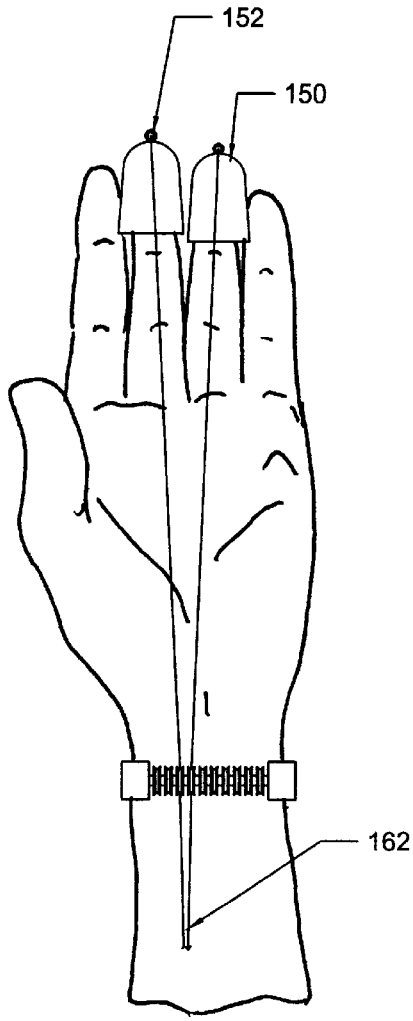
FIG. 11 is a top view of the FIG. 9.
Figure 12:
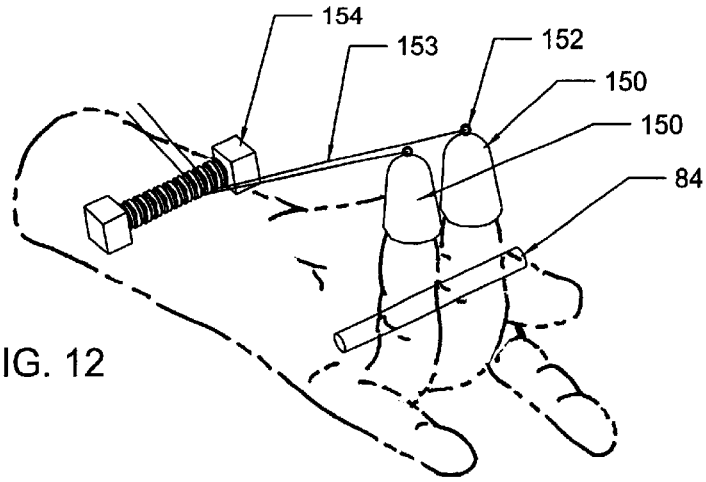
FIG. 12 is a perspective view showing use of the resistance bar or stabilization bar of the apparatus of the present invention for performing the exercise of FIG. 9.

Turning now to FIGS. 9 through 12, there is shown an additional use of the resistance-element means 84 or 86. As explained above, the apparatus 10 with its resistance bars 84, 86 may be used for performing digit, or finger, strengthening exercises. It is often desirable to orient the fingers being exercised such that their axes are positioned to meet at a central convergence point. The fingers being exercised are wrapped about a resistance bar or element 84, 86, as seen in FIG. 12, where just the resistance bar is shown, with the remainder of apparatus 10 being omitted for purposes of clarity and ease of understanding. To orient the fingers properly, each finger being strengthened or exercised is first provided with a cap or thimble-like cover 150, which is may be made of cloth, plastic, and the like. At the outer end thereof, there is provided a hook 152 by which an end of a wire, string, 153, or the like, may be secured. The other ends of the strings are wrapped about a special holder-element 154. The holder-element consists of a central bar 156 with end-plates 156'. Affixed to the central bar 156 are a plurality of fixed discs 160 spaced slightly apart from each along the length of the central bar 156. In preparing for the digit-strengthening exercise, the convergence point of those fingers to be exercised are determined, as by using tubes, or the like, and marking the convergence point 162 on the forearm of the patient, or by measuring the location of the convergence, point 162. Then a stabilizer bar is placed proximally to either MP, IP or DIP joints. Thereafter, the caps 150 are placed on the ends of the fingers, with the hooks 152 directed outwardly away from the hand. An end of a wire, string, or the like, is then secured to each hook 152, with the occupational therapist then pulling the other end of the string toward the forearm of the patient, in the manner shown in FIGS. 9, 11 and 12. The therapist passes the strings under chosen ones of the stationary discs 160, using trial and error, until the strings form an angle relative to each other such that they converge toward the convergence point 162, as seen in FIG. 11. When this has been accomplished, or during it, the strings are attached to a resistance bar, used in conjunction with the counterweight element, so that the resistance bar is balanced to zero. The patient is then asked to flex the fingers as much as possible. Each string 153 is still engaged about a circumferential portion of a respective, chosen disc 160. This pulling orients and fixes the fingers to be exercised at their proper positions where their axes converge toward their convergence point 162. The strings 153 are kept taut to ensure the fingers remain in such an orientation. Then, the fingers are flexed about the chosen joint by pulling back on the strings or wires 153, and then released to allow the fingers to return to their non-flexed state. This procedure is repeated a number of times, as needed, by the therapist. 2B.

If the patent is unable to flex the fingers at all, a small weight would be added to the resistance bar via the vertical rod 100 or 102. Weights will be added one at a time, until the patient flexes the fingers through his complete passive range of motion, as predetermined by the therapist through measurement with a goniometer, which is a device for measuring the range of motion of body parts. A previously-determined weight limit may be prescribed by the doctor, so the therapist must be careful not to exceed that weight. If the patent can only partially flex the involved fingers, then weights are added one at a time until the maximum range of motion, as predetermined by the therapist is reached. This is called Active Assistive Range of Motion (AAROM). By using this device as described, a therapist may now determine strength gains for a weak body part, not only by an increased amount of weight that the body part can move, but, by decreasing the amount of weight needed to assist the body part to move through its maximum range of motion. All digits, including toes, may be exercised in this manner, with guide wires or string guiding digits being directed toward convergence points, or paper lines of pull. Guide wires may be used and pulled by the therapist, and weight resistance added and used by pushing or pulling the resistance bar as well. Also, the entire procedure may be reversed and used for extension exercises.

Passive range of motion, active assistive range of motion, as well as active range of motion may also be used for any body part. Passive stretch may also be done with this device safely using the prescribed weight. In addition to strengthening body parts, this device may measure the relative movement of one body part relative to another, thus making it a new and useful tool for range of motion evaluation, like a goniometer.

With regard to the adjustable, movable stabilizer bar, it provides proximal stability, i.e.; it stabilizes the joint closest to the body other than the joint being moved. The following are the major and distinct advantages offered thereby, in contrast to prior-art apparatus that do not have such an element.

A) Stability provides safety to an injury body part.

B) Allows individual muscles or groups of muscles to be isolated and exercised (this limits the activity of other muscles on a movement); most body movements have more than one muscle capability of performing, or assisting with a movement. Some are the primary movers, some give assistance. By isolating muscles, one can target a specific muscle or group for strengthening which should facilitate greater and perhaps faster strengthening leading to optimal functional outcomes.

1) With the fingers, these are called blocking exercises, and the therapist must do this manually. A patient being trained to use this device may require less treatment time with the therapist, saving money.
2) Mobility of stabilizer (on foot)
   a) The fingers, hand or foot may be stabilized in virtually any position in vertical or horizontal planes. Injured or weak body parts may not have full range of motion, thus, when exercise is given, unusual positions may be needed.
3) Support of dual obliquity of hand and arches.
   a) Fingers do not move straight—there is an approximate 20° angle when bending them. Proximal stability can be achieved properly, allowing safe muscle isolation, by positioning a stabilization bar 56 or 58 and resistance bar or element 84, 86, at an appropriate angle, which is easily achieved owing to the multiple degrees of freedom of motion allotted thereto.
4) Stabilization with hand in neutral position (thumb pointed upwards) or variations.
   a) Hand strength testing is done with a device called a dynamometer. Norms have been standardized in neutral position. With the present invention, strengthening and testing can be done more closely approximating standardized norms, facilitating better assessment.
5) Facilitation of thumb movements (opposition and pinches). With an injured thumb, that hand is almost totally disabled. All fine motor skills use the thumb to pinch. The moveable stabilizer bar allows the thumb to be stabilized while fingers move toward it (with or without) resistance. The fingers may be stabilized while the thumb moves toward them, with or without resistance. The counterweight can also be used as a resistance bar; thus, there can be at least two resistance bars (more are possible) for opposition and pinch exercises. For example, such an exercise is to bring the thumb to the first finger, and the first finger to the thumb. Resistance is given to two separate digits starting from opposite directions and meeting at a single point. Also with individual finger loops attached to four fingers from one resistance bar, additional stabilizer bars can also be added and the thumb attached by a loop to the other resistance bar, whereby the thumb may be brought to each finger one at a time, with resistance given to each finger and the thumb. This is a common coordination exercise. Research has shown strength-training combined with fine motor skills or functional tasks, to be the most effective treatment for many hand deficits. The apparatus of the invention may be easily made to work in conjunction with many coordination tasks, such as above, or attaching a computer keyboard or a pressure switch. For example, a weak IP joint (weak flexors) can be stabilized with the resistance bar located at the appropriate place. A pressure switch may be mounted, where a child, for example, can press the switch which operates a toy. This is a common therapeutic activity, and now resistance with stabilization can be added. A violin or guitar neck could be mounted onto the frame, with fingers attached appropriately to resistance and stabilizer bars, to exercise appropriate finger movements. It could also combine resistance with some developmental and fine motor activities, such as writing or scissors cutting or peg board use. The apparatus of the invention may also be used for manual muscle testing, testing strength throughout a given range of motion. It may test and exercise pinches and different grasps throughout a functional range of motion, where as dynamometers and pinch gauges test only isometric strength. Statistical-Validity should be high as a weight machine inherently is. Reliability should also be high, as protocols are established that may reduce variables, such as substitution and lack of proper stabilization. The apparatus 10 will be safer and less expensive than electronic therapy devices. For example, the BTE has been shown to have lag time to initiate resistance, and also to give incorrect amounts of resistance, which can cause injury, not to mention power surges or short circuits on power outages. Most exercises can be performed in gravity reduced, eliminated against gravity, or gravity assisted positions. The apparatus 10 may provide a more accurate test for the lumbrical muscles.
6) Finger Abduction and Adduction Exercises
   a) These movements are when one moves one finger away from the next, which is abduction, and when bringing back together it is called adduction. One finger can be stabilized while another moves both away, then back towards it. The middle finger is the reference point. These are the small intrinsic muscles of the hand, which are also of great importance in fine motor skills. Currently, these exercises are done with putty or rubber bands. With the stabilizer bar of the present invention, these muscles can be better isolated and measured.

An important feature of the apparatus of the present invention is that the axis of the resistance arm must be as close as possible to the axis of the joint to be moved and exercised. Therefore, the resistance arm should be placed in the middle of the digit being moved. As each digit moves around an axis, it pushes the resistance bar around an axis, thereby obtaining constant resistance throughout a complete range of motion. This can be done with great efficiency.

Below are just a partial list of the various resistance exercises that may be performed using the apparatus of the present invention.

For distal-intercarpophalangeal joint (DIP) extension exercises, the resistance bar is on the opposite side of the digit. With hand pronated (palm down), the DIP rests just over the edge of the arm rest, with the stabilizer bar near the intercarpophalangeal (IP) joint (on top). Resistance bar in middle of digit is moved. The resistance bar is pushed upward, with the movement of DIP extension. In this against-gravity position, the axis of the resistance bar is adjacent to the axis of the DIP joint.

For individual finger IP join flexion exercises, in pronation with gravity assisted and palm facing down, the stabilizer bar rests on top of and proximal to the IP joint, with the finger straight. The IP joint axis is adjacent to the resistance bar axis (this is the first step). The resistance bar is placed in the middle of the digit distal, farther from the IP and underneath the digit. The resistance bar is then pushed downwards as the IP bends downward 90° to the complete range of motion. Prior to the exercise, the armrest is brought under the metacarpophalangeal (MP) joint for increased stability. The fingers not being exercised will rest on the top of the stabilizer bar.

For individual IP joint flexion in supination (against gravity) the palm faces up, the IP joint axis is located and brought adjacent to the resistance arm axis. The armrest is adjusted until it is under the 1P joint. The stabilizer bar is placed on top of the other digits not being exercised to decrease the amount of substitution and under IP. The resistance bar is placed in the middle of the digit distal to the IP. The digit is then flexed. For many finger-flexion exercises, the resistance bar may need to be of narrow diameter, or finger loops attached to resistance bar to allow complete range of motion. There will be many sizes and different shapes of resistance and stabilizer bars; flat, round, larger for use with entire hand, smaller for individual digits.

For IP individual finger extension, in pronation, IP joint axis is placed adjacent to resistance bar axis, the stabilizer bar under digit proximal to IP and on top of other fingers to eliminate their substitution. The finger is flexed downward as far as possible with the resistance bar up in middle and outside of digit distal to IP joint. The armrest is adjusted to underneath MP joints. The digit then pushes the resistance bar upward, until finger is completely extended.

For individual IP extension in supination, (gravity assisted), the IP joint axis is placed adjacent to the resistance bar axis, the stabilizer bar is placed proximal to and on top side of the IP joint and under the other fingers. The resistance arm is placed in the middle of the digit on the distal to IP joint outside, the bar resting underneath the digit. The armrest is adjusted to under the MP joint.

For individual MP joint flexion in pronation, the MP axis is placed adjacent to the resistance bar axis, and the stabilizer bar is on top of the digit distal to the MP joint, under other the fingers. The finger is the extended pushing the resistance bar down. The finger may be straight or flexed. The armrest is brought to just proximal to the MPs, and the resistance bar is underneath the digit distal to the MP joint in middle of the digit. The finger flexes downwardly through a complete range of motion.

For MP flexion in supination, the MP axis is placed adjacent to the resistance bar axis. The stabilizer bar is placed behind the digit being exercised and on top of the other fingers. The armrest is brought under the MPs and proximal to them. The resistance bar is brought to digit distal to the MP and proximal to IP. The finger is flexed upward at the MP joint to full MP flexion.

MP extension in pronation. Resistance axis is next to MP axis. Stabilizer bar under digit distal to MP joint and on top of other fingers, with fingers flexed downwards at 90°. Resistance bar on top of digit distal to MP. Finger then extended upwards to complete range of motion. Armrest is under hand proximal to MPs allowing fingers to be flexed downward.

MP extension is supination. Resistance axis is next to MP axis. Stabilizer on top of digit and in front, behind other fingers. Arm rest brought to under MPs, fingers flexed upward to 90°. Resistance arm in middle and outside digit proximal to MPs so that when finger is extended resistance bar is underneath finger.

Thumb IP flexion. Armrest is lowered or removed depending on size of hand. Hand and wrist and forearm in neutral position (thumb pointing upwards). Stabilizer bar distal to MP, and can be placed either in front or behind digit (research needed to find best position). Resistance bar in middle of thumb distal to IP joint. Thumb IP flexes downward against resistance bar (IP axis next to resistance bar axis). Two stabilization bars may be needed for some thumb exercises.

Thumb IP extension, hand and armrest in same position as for flexion. Stabilizer proximal and behind IP digit. Resistance axis next to IP axis. Resistance bar on top of and in middle of distal digit. Thumb extends upwards until it is straight.

Thumb CMP flexion. Hand in neutral finger loops may be needed in this exercise, attached to resistance bar. Loop attaches proximal to IP and distal to CMP. Thumb is flexed downwards across inside of hand. Resistance axis next to CMP axis near base of hand.

Thumb CMP extension hand in same position. Finger loop same as in flexion. Thumb flexed downwards, then flexes upwards. Stabilizer may be used near wrist, or.

Thumb Abduction. Hand pronated, armrest at base of wrist, thumb adducted (next to hand) use finger loop or resistance bar at middle and underneath thumb. Stabilizer bar under middle of other fingers. Abduct thumb downward. Resistance axis at base of thumb (CMP axis).

Thumb Abduction in Supination. Resistance axis at base of thumb, resistance bar on loop around middle of thumb. Arm rest under hand distal to MPs stabilizer bar on top of fingers near IP joints. Abduct thumb upward against resistance bar. Resistance axis next to CMMP AXIS (base of thumb).

Thumb Adduction is pronation armrest under wrist, with thumb abducted downwards, stabilizer under fingers near IP joints. Resistance axis at base of thumb and close to wrist. Finger loop or resistance bar in middle of thumb. Bring thumb upward to hand (adduction).

Opposition, Hand Supinated. Arm rest just proximal to MP joints. There are two ways to do this in supination. Thumb can move to fingers or fingers can move to thumb. Using finger loops on stabilizer and resistance bar may be the most efficient. Finger and thumb may move to each other with weight on each.

Thumb to fingers. Fingers flexed upwards with stabilizer bar inside of fingers approximately at IP joints. Resistance axis at base of thumb, with resistance bar (or loop attached to resistance bar) at middle of thumb. Bring thumb to one or more fingers one at a time.

Opposition in Supination, fingers to thumb. Arm rest under hand at MP joints. Thumb extended upwards with stabilizer inside and at middle of thumb. Resistance axis at MP joint axis (as close as possible to axis of all four fingers) (individual loops 1 per finger). Attached finger loops to resistance bar, attach them near IPs of finger (middle of fingers). Bring one finger at a time to thumb.

Because of the adaptability and multiple degrees of freedom of motion of the stabilization and resistance bars of the apparatus 10, many other body parts may be exercised and strengthened with the apparatus 10 of the invention. Unlike other occupational-therapy apparatuses, the apparatus 10 not only can work on the fingers, hands, and wrists, but can also be used on feet, calves, hips, neck, jaw, knee, as well as other parts of the body. Thus, the apparatus 10 may be called a true universal, occupational-therapy and physical-therapy, exercise machine.

It is to be noted that in the case of the apparatus 10 having just one resistance-element means 84 and associated mounting means, that only the rotatable disc 112 need be provided. In this case, the notch 134 would be provided also on the disc 112 just as the notch 132. Likewise, the spring-biased pawl element 138 would also be located in close operative juxtaposition with the disc 112 for operatively engaging with the notch 134. In this case, the disc 114 would not be required, since there would not be a disc 110. Also in this modification, it is possible to affix the end of the tie-wire 20 directly to the disc 112, thereby eliminating the central disc 116, as well.

While a specific embodiment of the invention has been shown and described, it is to be understood that numerous changes and modifications may be made therein without departing from the scope and spirit of the invention as set forth in the appended claims.

What I claim is:

1. In an apparatus for exercising and strengthening body part, which apparatus comprises a main frame, a resistance means, said resistance means comprising a resistance bar against which the body part to be exercised and strengthened contacts for rotating said resistance bar, variable biasing means operatively associated with said resistance means for providing a resistance to said resistance bar for performing exercises, first mounting means for mounting said resistance means to said main frame, and second mounting means for mounting, said variable biasing means to said main frame, said resistance bar having a first longitudinal axis, the improvement comprising:

an adjustable stabilization means comprising a stabilization bar, said stabilization bar having a second longitudinal axis and a plurality of degrees of freedom of movement, said adjustable stabilization bar being operatively associated in close proximity with said resistance bar for supporting a portion of a body part near the body part being exercised, the proximity of said adjustable stabilization bar to said resistance bar being variable in order to suit the body part being exercised, the type and condition of the person exercising, and the type of exercise being performed; and third mounting means for mounting said stabilization means to said main frame, said third mounting means mounting said stabilization bar for plurality of degrees of freedom of movement;

said third mounting means mounting said stabilization means to said main frame independently of said first mounting means that mounts said resistance means to said main frame;

said resistance bar and said stabilization bar being, therefore, independently and separately maneuverable from each other;

said first and third mounting means positioning said resistance bar and said stabilization bar such that said first and second longitudinal axes are substantially parallel to each other during the performance of exercise.

2. The apparatus for exercising and strengthening body parts according to claim 1, wherein said first mounting means for said resistance means mounts said resistance bar also for a plurality of degrees of freedom of movement.

3. The apparatus for exercising and strengthening body parts according to claim 2, wherein said first mounting means mounts said resistance bar for the same number of degrees of freedom of movement as said third mounting means mounts said stabilization bar.

4. The apparatus for exercising and strengthening body parts according to claim 2, wherein said third mounting means mounts said stabilization bar for at least three degrees of freedom of movement.

5. The apparatus for exercising and strengthening body parts according to claim 2, wherein said third mounting means mounts said stabilization bar for at least four degrees of freedom of movement.

6. The apparatus for exercising and strengthening body parts according to claim 2, wherein said third mounting means mounts said stabilization bar for at least five degrees of freedom of movement.

7. The apparatus for exercising and strengthening body parts according to claim 2, wherein said third mounting means mounts said stabilization bar for six degrees of freedom of movement.

8. The apparatus for exercising and strengthening body parts according to claim 3, wherein said first and third mounting means mount said resistance bar and stabilization bar, respectively, for at least three degrees of freedom of movement.

9. The apparatus for exercising and strengthening body parts according to claim 3, wherein said first and third mounting means mount said resistance bar and stabilization bar, respectively, for at least four degrees of freedom of movement.

10. The apparatus for exercising and strengthening body parts according to claim 3, wherein said first and third mounting means mount said resistance bar and stabilization bar, respectively, for at least five degrees of freedom of movement.

11. The apparatus for exercising and strengthening body parts according to claim 3, wherein said first and third mounting means mount said resistance bar and stabilization bar, respectively, for six degrees of freedom of movement.

12. The apparatus for exercising and strengthening body parts according to claim 1, wherein said third mounting means mounts said stabilization bar for rotation in a first horizontal plane, in a second vertical plane in a third plane at an angle relative to said second vertical plane, in a fourth plane substantially parallel to said third plane, and for translational movement in a first vertical direction, and in a second direction.

13. The apparatus for exercising and strengthening body parts according to claim 1, wherein said third mounting means mounts said stabilization bar for rotation in a first plane, in a second plane at an angle relative to said first plane, in a third plane at an angle relative to said second plane, in a fourth plane substantially parallel to said third plane, and for translational movement in a first direction, and in a second direction.

14. The apparatus for exercising and strengthening body parts according to claim 2, wherein each of said first and said third mounting means mounts said resistance bar and said stabilization bar, respectively, for rotation in a first horizontal plane, in a second vertical plane, in a third plane at an angle relative to said second vertical plane, in a fourth plane substantially parallel to said third plane, and for translational movement in a first vertical direction, and in a second direction.

15. The apparatus for exercising and strengthening body parts according to claim 2, wherein each of said first and said third mountings means mounts said resistance bar and said stabilization bar, respectively, for rotation in a first plane, in a second plane at an angle relative to said first plane, in a third plane at an angle relative to said second plane, in a fourth plane substantially parallel to said third plane, and for translational movement in a first direction, and in a second direction.

16. The apparatus for exercising and strengthening body parts according to claim 15, wherein said first plane is a horizontal plane, and said second plane is a vertical plane perpendicular to said first plane, said first and third mounting means mounting said resistance bar or said stabilization bar for movement in said second plane such that each said first and second longitudinal axis thereof is capable of assuming a position where each said longitudinal axis is vertically oriented and where each said longitudinal axis is horizontally oriented, whereby most body parts may be exercised using said resistance bar and stabilization bar.

17. The apparatus for exercising and strengthening body parts according to claim 2, wherein each of said first and said third mounting means mounts said resistance bar and said stabilization bar, respectively, for movement in a first, horizontal plane, and in a said second vertical plane substantially perpendicular to said first plane, said first and third mounting means mounting said resistance bar or said stabilization bar for movement in said second plane such that the respective said longitudinal axes thereof is capable of assuming a position where said longitudinal axis is substantially vertically oriented and where said longitudinal axis is substantially horizontally oriented, whereby most body parts may be exercised using said resistance bar and said stabilization bar.

18. The apparatus for exercising and strengthening body parts according to claim 2, further comprising another resistance means having another resistance bar, and fourth mounting means for mounting said another resistance means to said main frame in a location spaced from said first mounting means; said fourth mounting means also mounting said another resistance bar for a plurality of degrees of freedom of movement.

19. The apparatus for exercising and strengthening body parts according to claim 18, wherein each of said first, said third and said fourth mounting means mounts said resistance bar, said another resistance bar, and said stabilization bar, respectively, for movement in a first, horizontal plane, and in a said second vertical plane substantially perpendicular to said first plane, each of said first, said third and said fourth mounting means being capable of mounting each of said resistance bars or said stabilization bar in said second plane such that said longitudinal axis thereof is capable of assuming a position where said longitudinal axis is substantially vertically oriented and where said longitudinal axis is substantially horizontally oriented, whereby most body parts may be exercised using a said resistance means and said stabilization means.

20. The apparatus for exercising and strengthening body parts according to claim 1, wherein said main frame comprises a first and second upstanding mounting column for mounting said first and third mounting means, respectively; each of said first and third mounting means comprising adjustably-positional collar means for affixing the respective said first and third mounting means at a chosen height along said first and second upstanding mounting columns, respectively, and for swiveling the respective mounting means in a horizontal plane.

21. The apparatus for exercising and strengthening body parts according to claim 20, said main frame further comprising a third upstanding mounting column; and further comprising another stabilization means having another stabilization bar, and fourth mounting means for mounting said another stabilization means to said third upstanding mounting column; said fourth mounting means mounting said another stabilization bar such that said another stabilization bar is capable of use for supporting a portion of the body needing support when said resistance bar is used for exercising a body part.

22. The apparatus for exercising and strengthening body parts according to claim 1, further comprising another resistance means having another resistance bar, and fourth mounting means for mounting said another resistance means to said main frame in a location spaced from said first mounting means.

23. The apparatus for exercising and strengthening body parts according to claim 22, wherein said another resistance bar comprises a third longitudinal axis, and said another resistance means further comprises an upstanding rod perpendicular to said third longitudinal axis; and further comprising another biasing means comprising a plurality of individual weight-elements capable of being stacked by said upstanding rod, whereby said another resistance means has its own biasing force independent of the biasing force of said biasing means.

24. The apparatus for exercising and strengthening body parts according to claim 1, wherein said first mounting means comprises a mounting disc, and a leg-extension extending from said mounting disc, said leg-extension having a first channel formed therein; said first mounting means further having a slide-mount means slidable within said first channel for changing the position of said stabilization bar relative to said mounting disc; said mounting disc having a second channel formed in a portion thereof, said second channel extending from a section of the outer circumferential surface of said mounting disc radially interiorly therefrom; said first and second channels being coextensively aligned, whereby said slide-mount means may be positioned radially interior of said circumferential surface of said mounting disc in order to juxtaposition said stabilization bar as close as possible to said stabilization bar, whereby digit-exercises may be more optimally carried out.

25. The apparatus for exercising and strengthening body parts according to claim 24, wherein said slide-mount means comprises a central longitudinal axis; said central longitudinal axis of said slide-mount means being offset with said first longitudinal axis of said resistance bar, such that said central longitudinal axis of said slide-mount mounts is spaced a greater distance from said section of said circumferential surface of said mounting disc as said third longitudinal axis of said resistance bar, whereby when said slide-mount means extends into said second channel of said mounting disc, said resistance bar will be in closer juxtaposition to said stabilization bar.

26. The apparatus for exercising and strengthening body parts according to claim 1, wherein said biasing means comprises a variable resistance means for varying the load on said resistance means, whereby said biasing force is adjustable to suit the type of person, body part and exercise being performed; said apparatus further comprising limit-rotation means for limiting the degree of angular movement of said resistance means in order to suit such angular movement to suit to suit the type of person, body part and exercise being performed.

27. The apparatus for exercising and strengthening body parts according to claim 26, wherein said limit-rotation means comprises means for limiting the angular movement of said resistance-element means, and for varying the starting point of said angular movement; said means for limiting the angular movement of said resistance means comprising a rotatably mounted disc means, and rotatable mounting means for rotatably mounting said disc means for rotation; said rotatably mounted disc means being operatively connected to said first mounting means of said resistance-means; and means operatively associated with said rotatably mounted disc means for limiting the rotation thereof in both the clockwise and counterclockwise directions, whereby said arcuate degree of movement of said resistance means may be varied.

28. The apparatus for exercising and strengthening body parts according to claim 27, wherein said disc means comprises a plurality of arcuately-spaced openings formed thereabout; said first mounting means comprising a mounting disc that rotatably mounts said resistance means for movement in a plane, said mounting disc also comprising a plurality of arcuately-spaced openings that are alignable with said plurality of openings of said disc means;

said means for limiting the angular movement of said resistance means comprising interconnect means passing through respective ones of said plurality of openings of said disc means and said mounting means, whereby the relative initial position of said mounting disc relative, and therefore said resistance means, to said disc means is variable.

29. A device for biasing a lever of a resistance-element device used in an apparatus for exercising and strengthening body parts, comprising:

a first disc means affixed to a lever of a resistance-element device for rotation therewith;

a second disc means operatively associated with said first disc means for both conjoint rotation therewith and for relative rotation therebetween;

means for rotatably mounting said first and second disc means for rotation about a common axis;

each of said first and second disc means having a plurality of openings formed therein along at least one surface face thereof, each of said plurality of openings of said first disc cooperating and capable of alignment with a selected one of said plurality of openings of said second disc means;

biasing means for rotatably biasing said first and second disc means, said third disc means also having plurality of openings formed therein along at least one surface face thereof;

and interconnect means cooperating and extending through said selected openings of said plurality of openings of said first, second and third disc means for locking said first and second disc means together for conjoint rotation, and for allowing relative rotation therebetween when said interconnect means is removed therefrom, whereby the initial setting of a lever of a resistance-element means may be adjustably varied;

said third disc means sandwiched between said first and second disc means, said third disc means being operatively coupled to said biasing means.

30. The device according to claim 29, further comprising a limit-stop means for limiting the angular movement of said first and second disc means in both the clockwise and counterclockwise directions, whereby the degree of angular motion of a lever of a resistance-element means may be varied.

31. The device according to claim 29, further comprising:

a resistance means comprising a rotatable lever, and a resistance bar secured to said lever, said resistance bar having a first end and a second end, and mounting means associated with said second end for mounting said resistance bar to said lever; said lever having a first elongate channel in which is slidable and adjustably positional said mounting means;

said first disc means having a second elongate channel extending from a section of the circumferential surface thereof and radially interior therefrom, said first and second channels being coextensive, whereby said mounting means may be slid into said second channel in order to position said resistance bar closer said common axis of first and second disc means, in order that said resistance bar may be brought very close to a stabilization bar for performing digit-exercises.

* * * * *